US008261837B2

(12) United States Patent
Leonard et al.

(10) Patent No.: US 8,261,837 B2
(45) Date of Patent: Sep. 11, 2012

(54) ADJUSTABLE HANGER FOR INNER PRODUCTION RISER

(75) Inventors: Jerome T. Leonard, Houston, TX (US); Rockford D. Lyle, Pinehurst, TX (US); Alireza Shirani, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 321 days.

(21) Appl. No.: 12/492,821

(22) Filed: Jun. 26, 2009

(65) Prior Publication Data

US 2010/0018716 A1 Jan. 28, 2010

Related U.S. Application Data

(60) Provisional application No. 61/084,137, filed on Jul. 28, 2008.

(51) Int. Cl.
*E21B 7/12* (2006.01)

(52) U.S. Cl. ..... 166/345; 166/348; 166/382; 166/89.1; 166/88.2

(58) Field of Classification Search ..... 166/367, 166/345–349, 365, 378, 382, 89.1, 88.2
See application file for complete search history.

(56) References Cited

U.S. PATENT DOCUMENTS 4,607,865 A * 8/1986 Hughes ..... 285/18
4,949,786 A 8/1990 Eckert
5,244,313 A 9/1993 Pallini et al.
5,255,746 A 10/1993 Bridges
5,607,019 A 3/1997 Kent
5,638,903 A 6/1997 Kent
5,653,289 A 8/1997 Hosie et al.
5,671,812 A * 9/1997 Bridges ..... 166/348
5,899,638 A 5/1999 Pallini, Jr.
5,944,111 A 8/1999 Bridges
6,045,296 A * 4/2000 Otten et al. ..... 405/195.1
6,516,887 B2 * 2/2003 Nguyen et al. ..... 166/348
6,918,446 B2 * 7/2005 Borak, Jr. ..... 166/382
2002/0009336 A1 1/2002 Munk
2002/0100596 A1 8/2002 Nguyen
2004/0240947 A1 12/2004 Welch
2005/0238440 A1 10/2005 Jordan

* cited by examiner

*Primary Examiner* — Thomas Beach
*Assistant Examiner* — Aaron Lembo
(74) *Attorney, Agent, or Firm* — Bracewell & Giuliani LLP

(57) ABSTRACT

A string of conduit extending from a subsea wellhead assembly to a surface wellhead assembly on a platform has a plurality of grooved profiles on an upper portion of the conduit. Each profile is spaced axially from another of the grooved profiles. After a lower end of the conduit is secured to the subsea wellhead assembly, the operator pulls on the conduit to apply a selected tension to the conduit. The operator attaches a support ring to the profile that was closest to and above a load shoulder in the surface wellhead assembly when the desired tension was reached. After landing the support ring on the load shoulder, the operator may cut off any excess portion of the upper portion of the conduit located above the support ring. A seal ring is set between the upper portion of the conduit and the surface wellhead housing.

14 Claims, 3 Drawing Sheets

ADJUSTABLE HANGER FOR INNER PRODUCTION RISER

CROSS-REFERENCE TO RELATED APPLICATION

This application claims priority to provisional application 61/084,137 filed Jul. 28, 2008.

FIELD OF THE INVENTION

This disclosure relates in general to offshore oil and gas production equipment, and particularly to a hanger for supporting an inner riser string at a surface platform.

BACKGROUND OF THE INVENTION

One technique of offshore well production includes a platform located above sea level. The platform has a surface wellhead assembly, and a string of conduit extends from a subsea wellhead assembly to the surface wellhead assembly. Production tubing for the flow of well fluid is suspended at the surface wellhead assembly and extends through the conduit into the well. The string of conduit may comprise an inner riser string that is lowered through an outer riser string extending between the subsea and surface wellhead assemblies. A seal seals between the conduit and the bore of the surface wellhead assembly.

During installation of the string of conduit, its lower end will first be tied back into the subsea wellhead assembly, then the upper end is hung off on a load shoulder in the surface wellhead housing. Preferably the conduit is supported in tension. The conduit is typically casing that may be approximately 30 to 40 feet in length, thus it is unlikely that an assembled string of conventional casing would be the correct length to extend between the wellhead assemblies at a desired level of tension. Upper casing joints could be changed out for ones of different lengths, but this method takes time. A variety of methods and devices are known for accomplishing this type of installation, but improvements are desired.

SUMMARY

In this method, a plurality of grooved profiles are located on an upper portion of the conduit. Each profile is spaced axially from another. The operator secures a lower end of the conduit to the subsea wellhead assembly and pulls upward on the upper portion of the conduit to apply tension to the conduit until a selected one of profiles is located above a load shoulder provided in the surface wellhead assembly. The operator attaches a support ring to the selected one of the profiles, then lands the support ring on the load shoulder. The operator cuts off any excess portion of the upper portion of the conduit located above the support ring. A seal is installed between the upper portion of the conduit and the surface wellhead assembly.

In the preferred embodiment, each profile comprises an external threadform. An internal threadform is located in the support ring and engaging the internal threadform with one of the external threadforms. The mating threads allow the operator to rotate the support ring relative to the upper portion of the conduit to position the support ring at a desired point on the upper portion of the conduit.

Preferably the operator temporarily ceases the upward pull when a selected tension is reached. Then, the operator resumes upward pulling for an overpull increment greater than the distance from the load shoulder to a rim of the surface wellhead assembly. The operator selects the the profile that is above and the closest to the rim after the overpull as the one to attach the support ring. He positions the support ring such that an engaging surface of the support ring is a distance from the load shoulder equal to a length of the overpull increment. He then lowers the upper portion of the conduit a distance substantially equal to the length of the increment.

In the preferred embodiment, the support ring is split into segments and bolted around the selected the profile. Cutting off the excess part of the upper portion of the conduit may results in some of the profiles being on the excess portion that is cut off. Some of the profiles may be located below the support ring after installation.

An outer riser may extend between the subsea wellhead assembly and the surface wellhead assembly. The string of conduit may comprise an inner riser lowered through the outer riser.

DETAILED DESCRIPTION OF THE INVENTION

Figure 1:
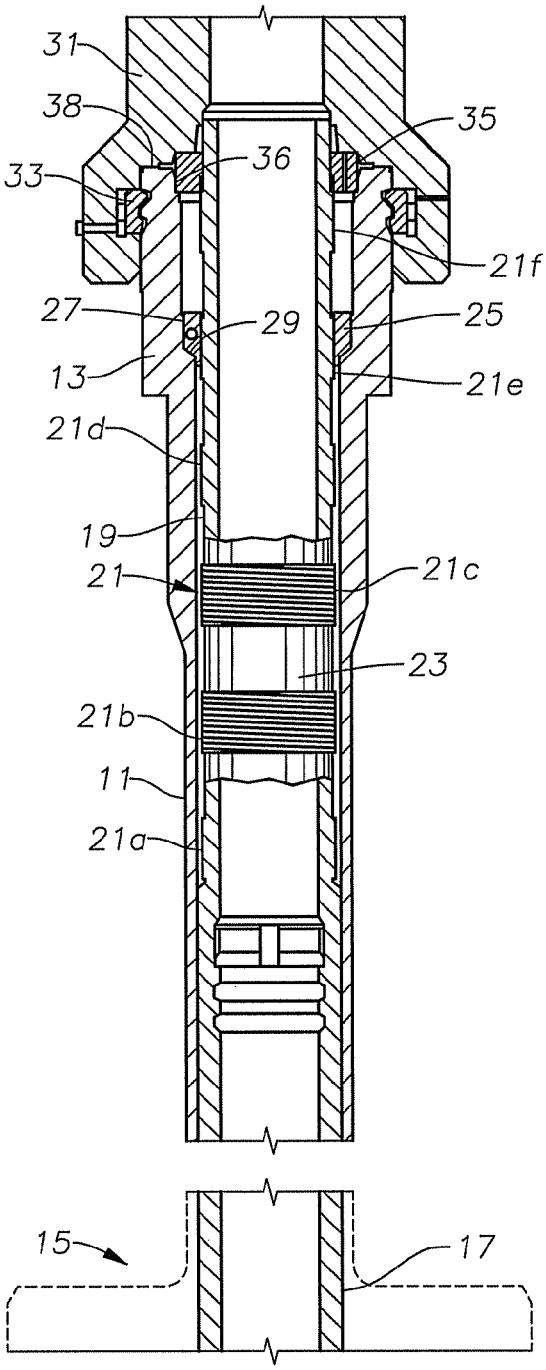
FIG. 1 is a partial sectional view illustrating an adjustable mandrel hanger in accordance with this invention in an installed position.

FIG. 1 illustrates an outer riser 11 that has a surface wellhead assembly or member 13 at its upper end, referred to herein as a casing head. Casing head 13 is a tubular member that is supported on a surface production platform (not shown). The lower end of outer riser 11 is secured at the seafloor to a subsea wellhead assembly 15. A string of conduit comprising an inner riser string 17 is suspended in tension between casing head 13 and part of subsea wellhead assembly 15. Inner riser string 17 is concentrically located within outer riser 11.

A mandrel 19 serves as part of a hanger mechanism for inner riser string 17 and makes up an upper portion of inner riser string 17. Mandrel 19 has several grooved profiles 21 formed on its exterior. Preferably profiles 21 comprise sets of external threads. As an example, profiles 21*a*, 21*b*, 21*c*, 21*d*, 21*e* and 21*f* are illustrated in FIG. 1, but the number could differ. Each profile 21 is axially separated from adjacent load profiles 21 by a smooth cylindrical seal surface 23. In this example, the axial length of each load profile 21 is approximately the same as each seal surface 23. For example, the axial length of each load profile and each seal surface 23 may be about 6 to 12 inches in axial length, but other dimensions may work as well. Also, it is not necessary that each seal surface 23 and each load profile 21 be of the same axial dimension. Preferably the threadform of each load profile 21 is the same, but it is not necessary that each threadform have the same axial length.

A split support ring 25 has threads on its inner diameter that mate with the threads of the load profiles 21. In the example shown, support ring 25 is shown in engagement with load profile 21*e*. Support ring 25 is preferably made of two semi-circular segments that are secured together, such as by one or more bolts 27. Split support ring 25 lands on and is supported by a load shoulder 29 in casing head 13. Split support ring 25 supports mandrel 19 and inner riser string 17 in a desired amount of tension.

Another wellhead member 31, such as a tubing spool, is shown mounted to rim 38 of casing head 13 by a connector 33. Tubing spool 31 has a bore within it that has a profile (not shown) for supporting a tubing hanger and a string of tubing (not shown) that extends through inner riser 17.

A seal ring 35 is shown in engagement with one of the seal surfaces 23 and in engagement with an upper profile 36 in casing head 13 located at rim 38 of casing head 13. In this example, seal ring 35 is engaging the seal surface 23 above load profile 21*f*. Optionally, the length of each seal surface 23 could be made to slightly exceed the distance from load shoulder 29 to the rim of casing head 13. This length would assure that an adequate portion of a seal surface 23 is engaged by seal ring 35 when support ring 25 has landed on load shoulder 29. Seal ring 35 is an annular member that in this example is supported on an upper end profile 36 within casing head 13. A lower end portion of tubing spool 31 is in contact with an upper side of seal ring 35.

Figure 2:
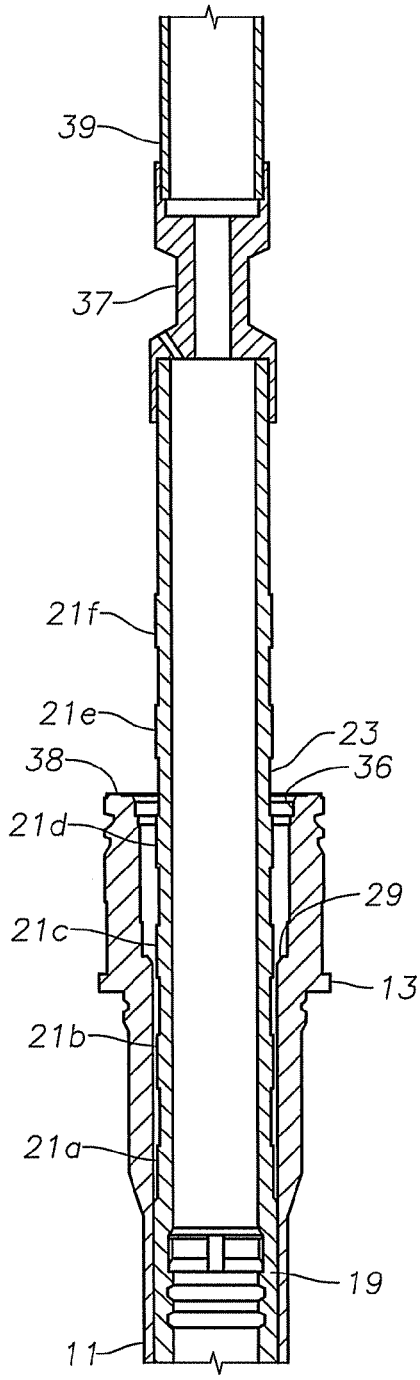
FIG. 2 is a view of the mandrel hanger of FIG. 1 shown being lowered into the outer riser.
Figure 3:
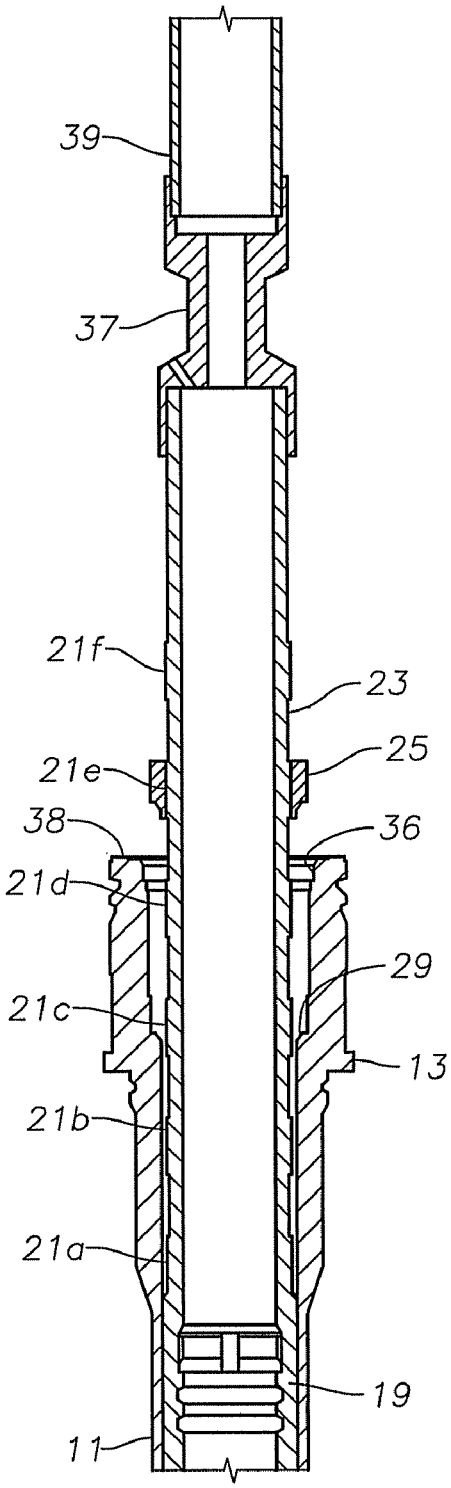
FIG. 3 illustrates the operator pulling upward on the mandrel hanger after latching a tieback at the lower end of the inner riser to the subsea wellhead assembly.

FIG. 2 illustrates a first step in installing inner riser string 17. Inner riser string 17 (FIG. 1) is made up with a tieback connector (not shown) on its lower end and lowered through outer riser 11. When the tieback connector nears the subsea wellhead assembly 15, the operator attaches mandrel 19 to the upper end of inner riser 17. An adapter 37 or a gripping member of some type is secured to an upper end of mandrel 19. Adapter 37 may be secured to the upper end of a conduit 39 that is lowered by lifting equipment on the surface platform, such as elevators attached to a top drive. Alternately, adapter 37 could be connected directly to the lifting equipment. The operator lowers the assembly and latches the tieback connector to a tieback receptacle in subsea wellhead assembly 15 (FIG. 1) to secure the lower end of inner riser 17.

The operator then lifts conduit 39 to apply tension to inner riser string 17. At the desired tension level, one of the load profiles 21 will be at least partially above and the closest to load shoulder 29. Because load shoulder 29 is recessed within casing head 13, the operator may not know the exact position of the closest load profile 21, but the operator will know the distance from load shoulder 29 to casing head rim 38. The operator may note the elevation of a point on mandrel 19 when inner riser string 17 is at the desired tension, such as by marking a chalk line at a point on mandrel 19 that is flush with the rim of casing head 13. The operator then pulls upward on inner riser string 17 for an increment at least equal to the distance from load shoulder 29 to rim 38 and sufficient to place at least one of the load profiles 21 in an accessible position, such as above rim 38 of casing head 13. Depending upon the length of inner riser string 17 (FIG. 1) and the distance from subsea wellhead assembly 15 to load shoulder 29, several load profiles 21 may be located above rim 38 of casing head 13 at that overpull increment. By measuring from new position of the chalk mark back to rim 38, the operator will know the length of the increment that he overpulled. The operator selects the load profile 21 that is the closest to but above rim 38 while at the overpull position. In this example, load profile 21*e* is the one selected. Now that load profile 21*e* is accessible, the operator connects split support ring 25 to load profile 21*e*. Bolt 27 (FIG. 1) will hold split support ring 25 in place. The operator may rotate split support ring 25 upwardly or downwardly on the particular load profile 21*e* to position support ring 25 at the desired position for the desired final tension. The distance from the lower engaging surface of support ring 25 to support shoulder 29 while in this overpull position should equal the length of the overpull increment. If not, the operator rotates split support ring 25 so that the distance does approximately equal the overpull increment.

Figure 4:
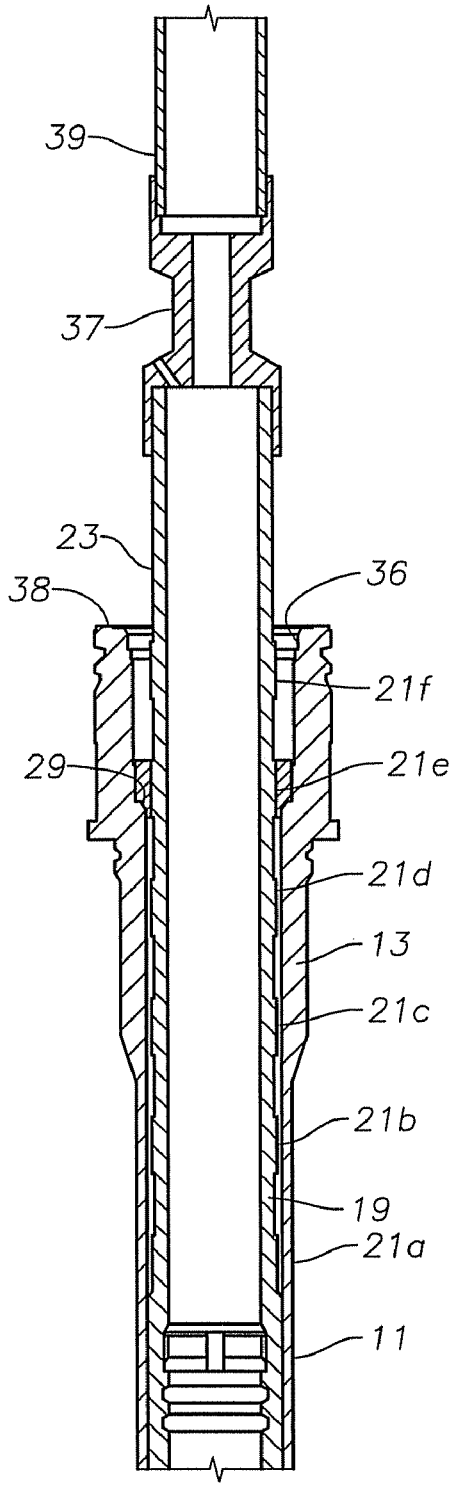
FIG. 4 shows the mandrel hanger being lowered into landed engagement in the casing head after tensioning the inner riser.
Figure 5:
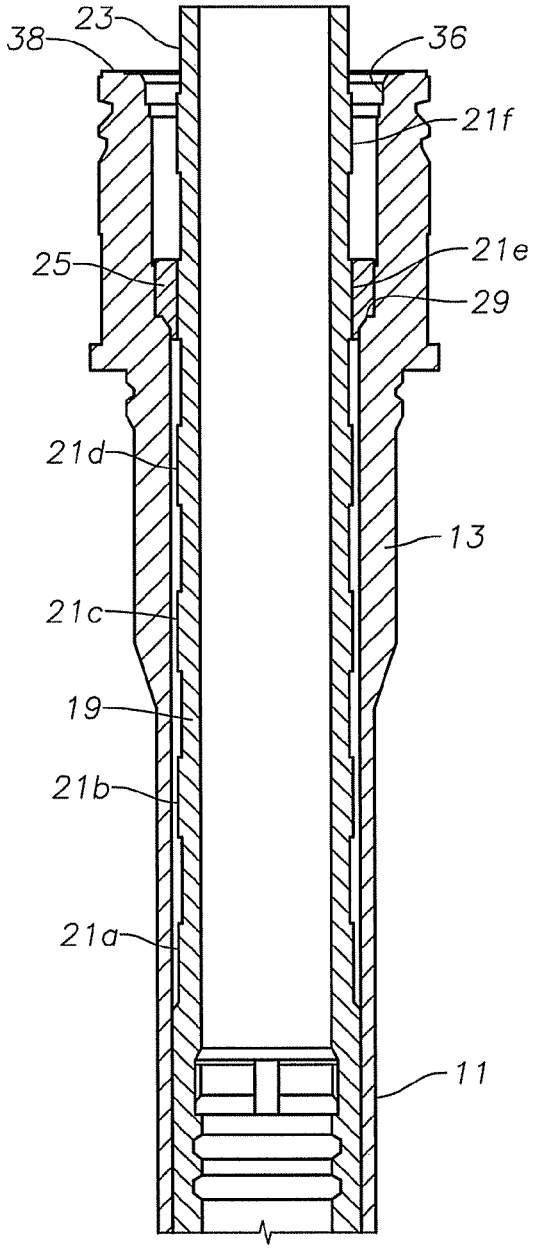
FIG. 5 is a view similar to FIG. 4, but showing an upper end of the mandrel hanger cut off in preparation for receiving a seal and tubing spool.

Referring to FIG. 4, the operator then lowers conduit 39 until split support ring 25 lands on landing shoulder 29, relieving any tension in mandrel 19 above split support ring 25. Inner riser string 17 and mandrel 19 below split support ring 25 will be at the desired level of tension. The amount that the operator lowered conduit 39 should equal the length of the overpull increment. One of the seal surfaces 23 will be located adjacent the upper end of casing head 13. The axial lengths of each load profile 21 and each seal surface 23 have been selected so that when one of the load profiles 21 is aligned with casing head load shoulder 29, one of the seal surfaces 23 will be located adjacent upper end profile 36 of casing head 13. This arrangement results in a smooth seal surface 23 always being positioned adjacent upper end profile 36, thus no additional machining is needed.

Figure 6:
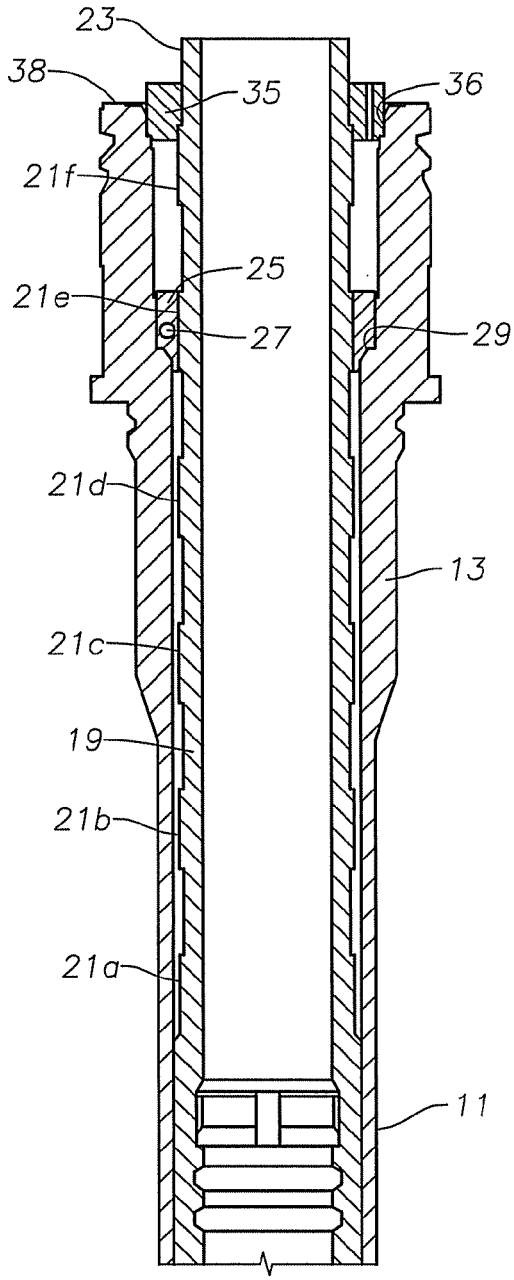
FIG. 6 is a view of the mandrel hanger after the seal is installed and before installing the tubing spool.

The operator then detaches adapter 37 and cuts off the upper end of mandrel 19 at a desired elevation, typically above casing head 13, so as to not interfere with tubing spool 31. As shown in FIG. 6, the operator then installs seal ring 35. The outer lower portion will engage upper end profile 36 and the inner sealing portion will seal against one of the seal surfaces 23. In this instance, it seals against the seal surface 23 located just above load profile 21*f*. The operator then installs tubing head 31 (FIG. 1) and completes the well in a conventional manner.

While the invention has been shown in only one of its forms, it should be apparent to those skilled in the art it is not so limited but is susceptible to various changes without departing from the scope of the invention.

The invention claimed is:

1. A method of connecting a string of conduit extending from a subsea wellhead assembly to a surface wellhead assembly on a platform, the surface wellhead assembly having a load shoulder therein, comprising:

(a) providing a plurality of grooved profiles on an upper portion of the conduit, each profile being spaced axially from another of the grooved profiles relative to an axis of the conduit;

(b) securing a lower end of the conduit to the subsea wellhead assembly and pulling upward on the upper portion of the conduit with an adapter to apply at least a final tension to the conduit until a selected one of the profiles is located above an upper end of the surface wellhead assembly;

(c) attaching a support ring to the selected one of the profiles while the tension is maintained and the selected one of the profiles is above the upper end of the surface wellhead assembly after pulling upward on upper the portion of the conduit;

(d) lowering the support ring into the surface wellhead assembly with the adapter and landing the support ring on the load shoulder to set the final tension; and (e) cutting off any excess of the upper portion of the conduit located above the support ring.

2. The method according to claim 1, wherein:

step (a) comprises machining an external threadform on the upper portion of the conduit for each of the profiles, the threadform comprising a plurality of grooves more closely spaced to each other than an axial distance between each of the profiles; and step (c) comprises providing an internal threadform in the support ring and engaging the internal threadform with one of the external threadforms.

3. The method according to claim 2, wherein step (c) comprises rotating the support ring relative to the upper portion of the conduit to position the support ring at a desired point on the upper portion of the conduit.

4. The method according to claim 1, wherein step (b) comprises:

temporarily ceasing upward pull when a selected tension is reached and noting the elevation of a point on the upper profile; then resuming upward pulling of the conduit at least for an increment greater than the distance from the load shoulder to the upper end of the surface wellhead assembly, the selected one of the profiles being the profile that is above and the closest to the upper end of the subsea wellhead assembly after the increment has been pulled; then performing step (c) and positioning an engaging surface of the selected one of the profiles a distance from the load shoulder equal to a length of the increment; then performing step (d) by lowering the upper portion of the conduit a distance substantially equal to the length of the increment.

5. The method according to claim 1, wherein the support ring is split into segments, and step (c) comprises positioning the segments about the selected one of the profiles.

6. The method according to claim 1, wherein step (e) results in at least one of the profiles being on the excess that is cut off.

7. The method according to claim 1, wherein:

step (a) comprises forming a sealing surface between each of the profiles; and the method further comprises setting a seal between one of the sealing surfaces and the surface wellhead assembly.

8. The method according to claim 1, further comprising securing a wellhead member to the upper end of the wellhead assembly after step (c).

9. The method according to claim 1, wherein:

an outer riser extends between the subsea wellhead assembly and the surface wellhead assembly; and step (a) is performed by lowering the conduit through the outer riser.

10. A method of connecting a string of conduit extending from a subsea wellhead assembly to a surface wellhead assembly on a platform, the surface wellhead assembly having a load shoulder therein, the method comprising:

(a) providing a plurality of threaded profiles on an upper portion of the conduit, each profile being spaced axially from another of the profiles relative to an axis of the conduit, defining seal surfaces between adjacent ones of the profiles;

(b) securing a lower end of the conduit to the subsea wellhead assembly and pulling upward on the upper portion of the conduit with an adapter to apply a final tension to the conduit;

(c) with the adapter, continuing to pull upward on the upper portion of the conduit an overpull increment from the final tension, the overpull increment being greater than a distance from the load shoulder to an upper end of the subsea wellhead assembly;

(d) after pulling upward the overpull increment and while maintaining tension at the overpull increment, clamping segments of an internally threaded support ring to a selected one of the profiles and positioning an engaging surface of the support ring a distance above the load shoulder equal to a length of the overpull increment;

(e) with the adapter, lowering the upper portion of the conduit for the length of the overpull increment and landing the engaging surface of the support ring on the load shoulder to set the final tension;

(f) cutting off any excess portion of the upper portion of the conduit located above the support ring; and (g) after the engaging surface of the support ring has landed on the load shoulder, setting a seal above the support ring between one of the seal surfaces on the conduit and the surface wellhead assembly.

11. The method according to claim 10, wherein step (d) also comprises rotating the support ring relative to the upper portion of the conduit to position the engaging surface of the support ring the distance above the load shoulder equal to a length of the overpull increment.

12. The method according to claim 10, further wherein step (d) comprises bolting the segments together.

13. The method according to claim 10, wherein step (f) results in at least one of the profiles being on the excess portion that is cut off.

14. The method according to claim 10, wherein:

an outer riser extends between the subsea wellhead assembly and the surface wellhead assembly; and step (a) is performed by lowering the conduit through the outer riser.

* * * * *